United States Patent [19]

Johns

[11] 4,330,025

[45] May 18, 1982

[54] NOZZLE IN A STRIP CASTING APPARATUS

[75] Inventor: Robert H. Johns, Natrona Heights, Pa.

[73] Assignee: Allegheny Ludlum Steel Corporation, Pittsburgh, Pa.

[21] Appl. No.: 185,825

[22] Filed: Sep. 11, 1980

[51] Int. Cl.[3] ..... B22D 11/06; B22D 11/10

[52] U.S. Cl. ..... 164/423; 164/429; 164/437

[58] Field of Search ..... 164/423, 427, 429, 437, 164/462, 463, 479, 488; 222/606, 607, 566, 575; 118/407, 410, 401

[56] References Cited

U.S. PATENT DOCUMENTS 905,758 12/1908 Strange ..... 164/463

4,142,571 3/1979 Narasimhan .

*Primary Examiner*—R. L. Spruill

*Assistant Examiner*—K. Y. Lin

*Attorney, Agent, or Firm*—Patrick J. Viccaro; Vincent G. Gioia

[57] ABSTRACT

An improved nozzle is disclosed for a strip casting apparatus wherein molten metal is delivered to a casting surface located within about 0.120 inch of the nozzle, and is movable past the nozzle at a speed of from 200 to 10,000 linear surface feet per minute. The improved nozzle comprises a pair of spaced orifice lips substantially parallel to and facing one another, with the spacing being substantially uniform throughout the majority of the longitudinal extent of the nozzle. The peripheral end portions of the orifice lips continuously diverge outwardly from one another for a length of less than about three times the substantially uniform spacing between lips, and for a height of less than about two times the substantially uniform spacing between lips.

2 Claims, 5 Drawing Figures

NOZZLE IN A STRIP CASTING APPARATUS

BRIEF SUMMARY OF THE INVENTION

The present invention relates to an improved apparatus for rapidly casting metallic strip material. More particularly, the present invention pertains to a specific construction for the nozzle, or orifice passage, of a strip casting apparatus which maintains the quality, specifically the edge quality of the strip material being cast.

As the development of metal strip casting matures, various design features are found to have significant impact on the successfulness of a strip casting operation. One such design feature is the shape of the nozzle or orifice passage through which molten metal is delivered to a chilled casting surface.

The prior art teaches various slot configurations for strip casting apparatus. For example, U.S. Pat. No. 905,758 teaches that a molten metal outlet or orifice may be tubular or slitted. Also, U.S. Pat. No. 4,142,571 teaches the use of a rectangular slot or the preferred use of a slot with lobed end sections. Such lobed, or generally rounded end sections, generally illustrated in FIG. 5 of this application, are said to provide adequate molten metal flow at the marginal portions of such slot during strip casting, and thereby provide a smooth-edged filament product.

It has been found that a strip having a uniform gage, even at the end portions, is not always obtained through slots having rounded end sections. Such rounded end sections do provide a smooth, generally rounded edge on such strip material, however, a generally planar edge is more desirable.

Accordingly, a new and improved apparatus for casting metallic strip material is desired which insures that the strip produced thereby has a uniform gage across the strip, particularly including the edge portions of the strip, and further provides a substantially planar edge surface for the strip produced through the nozzle of such apparatus.

The present invention may be summarized as providing an improved nozzle for a strip casting apparatus wherein molten metal is delivered to a casting surface located within about 0.120 inch of the nozzle, and is movable past the nozzle at a speed of from 200 to 10,000 linear surface feet per minute. The improved nozzle comprises a pair of spaced orifice lips substantially parallel to and facing one another, with the spacing being substantially uniform throughout the majority of the longitudinal extent of the nozzle. The peripheral end portions of the orifice lips continuously diverge outwardly from one another for a length of less than about three times the substantially uniform spacing between lips, and for a height of less than about two times the substantially uniform spacing between lips.

Among the advantages of the present invention is the provision of an apparatus for producing metallic strip material of high quality, particularly including high edge quality.

An objective of this invention is to provide an apparatus having a nozzle configuration which insures substantially uniform gage of the strip material across the transverse width of the strip including the edge portions of the strip.

A further objective of this invention is to provide a strip casting apparatus which promotes high quality strip material, including an improved edge surface characterized by a substantially planar edge surface.

An advantage of this invention is that metallic strip material produced thereby is provided with a desirable straight edge surface which eliminates the necessity for edge trimming of the strip material.

These and other objectives and advantages will be more fully understood and appreciated with reference to the following detailed description and to the accompanying drawings.

DETAILED DESCRIPTION

Figure 1:
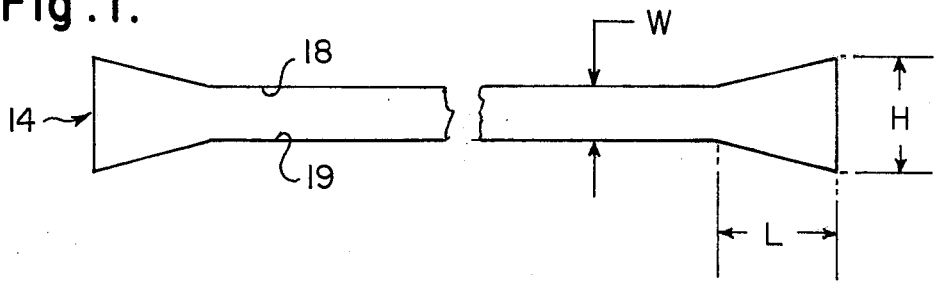
FIGS. 1 through 4 illustrate a schematic view of preferred profiles for the nozzles of the present invention.

Strip casting apparatus which may employ the nozzle of the present development are disclosed in co-filed U.S. Patent Application Ser. No. 148,440, filed May 9, 1980 entitled Apparatus For Strip Casting assigned to the assignee of the present application, and incorporated herein by reference.

As explained in the referenced application the strip casting apparatus to which the present invention applies typically includes a tundish having an internal cavity for receiving and holding molten metal. The tundish further includes a nozzle 14, or orifice passage, through which the molten metal in the tundish cavity is delivered to a casting surface. The casting surface is located within about 0.120 inch of the nozzle and is movable past the nozzle at a speed of from about 200 to 10,000 linear surface feet per minute.

The improvement of the present invention as best illustrated in the drawings is directed to the profile or shape of the nozzle 14, particularly the shape of the lateral end portions of the nozzle 14. The nozzle 14 comprises an upper lip 18 and a lower lip 19. The terms upper and lower should refer to upstream and downstream portions respectively, of the nozzle 14 with respect to the direction that the casting surface is moved past the nozzle 14.

The upper lip 18 and the lower lip 19 are substantially parallel to and facing one another, with the spacing or width W, therebetween being substantially uniform throughout the majority of the longitudinal extent of the nozzle 14. The peripheral end portions of the nozzle do not maintain such substantially uniform spacing relationship. Rather, the peripheral end portions of the orifice lips continuously diverge outwardly from one another in the direction of the edge of the nozzle 14. It has been found that the diverging portion must be located at the peripheral edges of the nozzle. Accordingly, the length, L, of such diverging portion must be less than about three times the substantially uniform spacing, W, between the lips. It has also been found that the amount of divergence cannot be too great. Accordingly, the maximum height, H, of such diverging portion must be less than about twice the substantially uniform spacing, W, between the lips.

In a preferred embodiment the peripheral and portions of the orifice lips 18 and 19 continuously diverge outwardly from one another for a length, L, of less than about twice the substantially uniform spacing, W, between lips 18 and 19, and for a height, H, of less than about 1.5 times the substantially uniform spacing, W, between lips 18 and 19.

Figure 2:
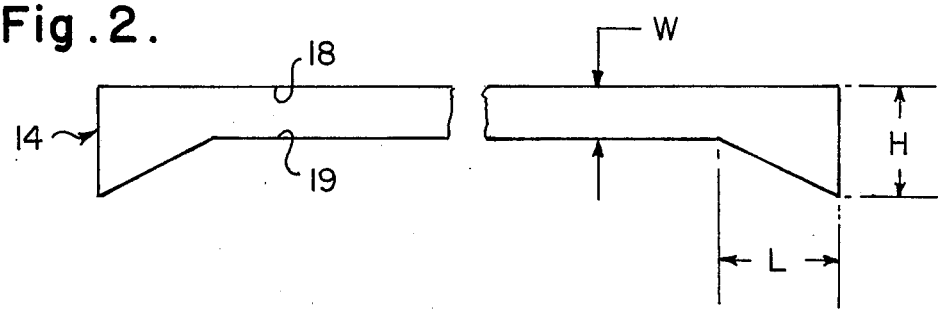

As shown in FIG. 1, such outward divergence may be obtained by cutting, carving or otherwise diverging both the upper lip 18 and the lower lip 19 away from one another in the direction of the edge of the nozzle 14. Alternatively, as shown in FIG. 2, the upper lip 18 may remain substantially planar and the lower lip 19, alone, may be cut, carved or otherwise disposed to diverge from the upper lip 18 and establish the continuous outward divergence required in the present invention.

Figure 3:
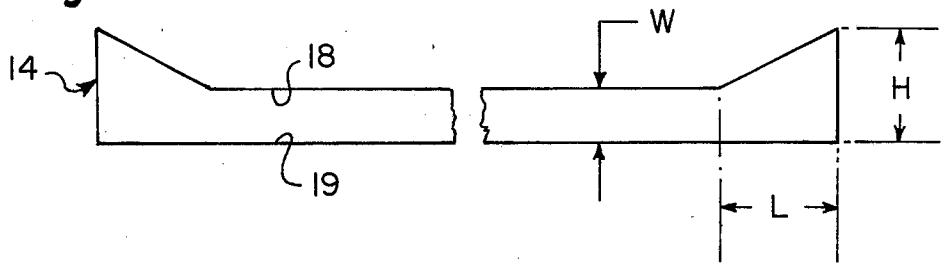

In another embodiment as illustrated in FIG. 3, the lower lip 19 may remain substantially planar and the upper lip 18, alone, may be disposed to diverge from the lower lip 19, and establish the required continuous outward divergence within the length, L, and height, H, dimensions set forth above.

Figure 4:
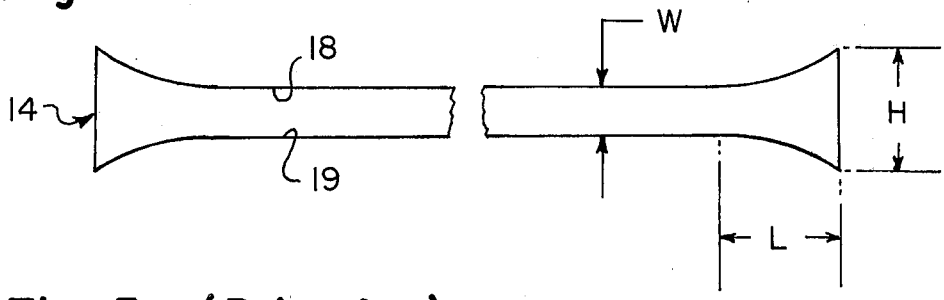

FIG. 4 shows that the diverging edge portions of the nozzle 14 do not have to be linear, rather such diverging portions may be arcuate. It should be appreciated that such arcuate divergence could also be established by diverging only one of the end portions of the nozzle lips, in addition to diverging both end portions of the nozzle lips as illustrated in FIG. 4.

Regardless of the type of divergence provided for the end portions of the nozzle 14, the above maximum limitations on the length, L, and height, H, of such divergence must be followed. Additionally, and importantly the divergence must be continuous in the direction of the edge of the nozzle 14. By continuous divergence, it is meant that the height dimension, H, between the facing lips 18 and 19, continuously increases in the direction of the edge of the nozzle 14. Such height dimension, H, cannot decrease in the direction of the edge of the nozzle 14.

By such continuously diverging relationship, as described above, the edge surfaces of the nozzle of the present invention must, necessarily be substantially parallel to one another, and substantially perpendicular to the uniformly spaced lips 18 and 19 as illustrated in FIGS. 1 to 4. The prior art suggested that such nozzle edge surfaces could be rounded, which has been found to provide a rounded edge on the strip rather than the desirable planar edge on the strip, which is obtained when casting through a nozzle of the present invention.

Figure 5:
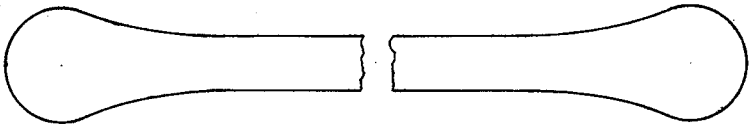
Fig. 5. (Prior Art)
FIG. 5 illustrates a schematic view of a nozzle profile of the prior art.

Note in the prior art nozzle profile illustrated in FIG. 5 that the height dimension increases in the direction of the edge of the nozzle and then decreases in such direction. Such prior art structure actually results in delivering less metal to the edge portion of the nozzle, and results in the formation of a rounded edge strip, which for certain applications requires slitting or other edge trimming, prior to use.

The nozzle 14 of the present invention typically has a longitudinal extent in excess of one inch and may have a longitudinal extent of as much as 36 inches, or more. For this reason the nozzle 14 profile is illustrated in broken lines. When producing such wide strip material, it has been found that providing a nozzle 14 which facilitates increased metal flow at its edges results in increased quality strip material. In particular, the nozzle profile of the present invention has been found to provide a marked increase in the edge quality of the strip material produced therethrough. Such strip is characterized by substantially uniform gage across the transverse width thereof, specifically including the edge portions of such strip. Additionally, such edge surfaces are desirably generally planar in structure, which usually eliminates the need for slitting or other edge trimming operations to be performed before such strip is used.

Whereas the preferred embodiments of the present invention have been described above for the purposes of illustration, it should be understood that various modifications of the details of this invention may be made without departing from the intended scope of this invention.

I claim:

1. In a strip casting apparatus wherein molten metal is delivered to a casting surface located within 0.120 inch of the orifice defined in a nozzle and movable past the orifice at a speed of from 200 to 10,000 linear surface feet per minute, wherein said nozzle comprising:

a pair of spaced orifice lips substantially parallel to and facing one another, said spacing being substantially uniform throughout the substantial longitudinal extent thereof, and a pair of edge surfaces substantially parallel to one another and substantially perpendicular to said pair of spaced orifice lips and defining the orifice with said pair of spaced orifice lips, and the end portions of said orifice lips continuously diverging outwardly from one another to said edge surfaces for a length of less than about three times the substantially uniform spacing between lips, and for a total height of each of said edge surfaces of less than about twice the substantially uniform spacing between lips.

2. An appartus as set forth in claim 1 wherein the end portions of said orifice lips continuously diverge outwardly from one another for a length of less than about twice the substantially uniform spacing between lips, and for a total height of each of said edge surfaces of less than about 1.5 times the substantially uniform spacing between lips.

* * * * *